United States Patent [19]

Lind

[11] Patent Number: 4,630,423

[45] Date of Patent: Dec. 23, 1986

[54] SUSPENDED-CEILING FRAMEWORK ASSEMBLY

[75] Inventor: Larry W. Lind, Spring Valley, Calif.

[73] Assignee: United States Elevator Corporation, Spring Valley, Calif.

[21] Appl. No.: 686,002

[22] Filed: Dec. 24, 1984

[51] Int. Cl.[4] ..... E04B 5/52

[52] U.S. Cl. ..... 52/484; 52/664; 248/224.4; 248/317

[58] Field of Search ..... 52/483, 484, 489, 664, 52/238.1, 239–243, 243.1; 248/222.1, 224.4, 317

[56] References Cited

U.S. PATENT DOCUMENTS

| | | | |
|---|---|---|---|
| 2,216,319 | 10/1940 | McGee | 52/243 |
| 3,093,221 | 6/1963 | Purdy | 52/484 |
| 3,241,799 | 3/1966 | Terlinde | 248/222.1 |
| 3,867,802 | 2/1975 | Murphy | 52/483 |
| 4,027,446 | 6/1977 | Brugman | 52/484 |
| 4,483,502 | 11/1984 | Fast | 248/222.1 |
| 4,520,607 | 6/1985 | Suckow | 52/489 |

FOREIGN PATENT DOCUMENTS

| | | | |
|---|---|---|---|
| 228182 | 6/1958 | Australia | 52/484 |
| 6404889 | 11/1965 | Netherlands | 52/664 |

*Primary Examiner*—John E. Murtagh
*Assistant Examiner*—Andrew Joseph Rudy
*Attorney, Agent, or Firm*—Brown, Martin, Haller & Meador

[57] ABSTRACT

A suspended-ceiling framework defining a skeletal support for ceiling panels in an elevator cab includes a right angle bracket with which to hang a section of framing rail from an elevator roof or other support structure. The bracket defines a horizontally-extending slot into which an outwardly-extending lug on the framing rail fits to enable the framing rail to be hooked onto and supported by the bracket, the lug including a downwardly-extending portion that just fits through the slot. A retaining clip mounted with one screw on the bracket after the lug is inserted extends into the slot to bear against and retain the lug in predetermined alignment as well as block removal.

9 Claims, 6 Drawing Figures

SUSPENDED-CEILING FRAMEWORK ASSEMBLY

BACKGROUND OF THE INVENTION

This invention relates in general to suspended ceilings and particularly pertains to a framework assembly suitable for supporting ceiling panels in an elevator cab.

A popular way to provide a finished ceiling for a room or other enclosed area, suspended ceilings are easily installed and relatively inexpensive. Lightweight ceiling panels with desired acoustical and aesthetic attributes are placed on a skeletal support, or framework assembly, that is suspended from a roof or other support structure.

However, existing framework assemblies have certain drawbacks. One major problem is that their assembly requires a degree of skill and manual dexterity beyond that appropriate for assembly in the field. Consequently, existing framework assemblies for elevator cabs may take up to four hours to assemble, and even then the assembled framework is often misaligned.

Therefore, it is desirable to have a new framework assembly that alleviates these problems.

It is desirable to have a framework assembly that can be easily and rapidly assembled in the field with a minimum of skill and manual dexterity.

It is desirable that the assembly employ a minimum number of parts, and that the parts fit together in predetermined alignment.

It is desirable that the framework assembly be compatible with existing ceiling panels.

And, it would be advantageous to have a framework assembly that inhibits removal of ceiling panels by occupants of an elevator cab shoving them up and out of the framework assembly.

SUMMARY OF THE INVENTION

This invention recognizes the problems of the prior art and provides a new and improved suspended ceiling framework assembly with the desired attributes.

An exemplary embodiment includes a bracket on which to hang a section of framing rail. The bracket defines a rectangularly-shaped slot, and the section of rail includes an outwardly-extending lug that fits into the slot. This enables the section of rail to be hooked onto and supported by the bracket.

The lug includes a downwardly-extending portion that just fits through the slot. Once the lug is inserted, a retainer clip is mounted on the bracket so that it extends into the slot. In this position the clip bears against the lug to retain the lug, and the section of rail, in predetermined alignment with the bracket. The retaining clip also blocks removal of the lug from the slot.

The above and other objects and many attendant advantages of the invention will become more fully apparent upon a reading of the detailed description in conjunction with the drawings wherein like numerals refer to like components throughout.

DETAILED DESCRIPTION

Figure 1:
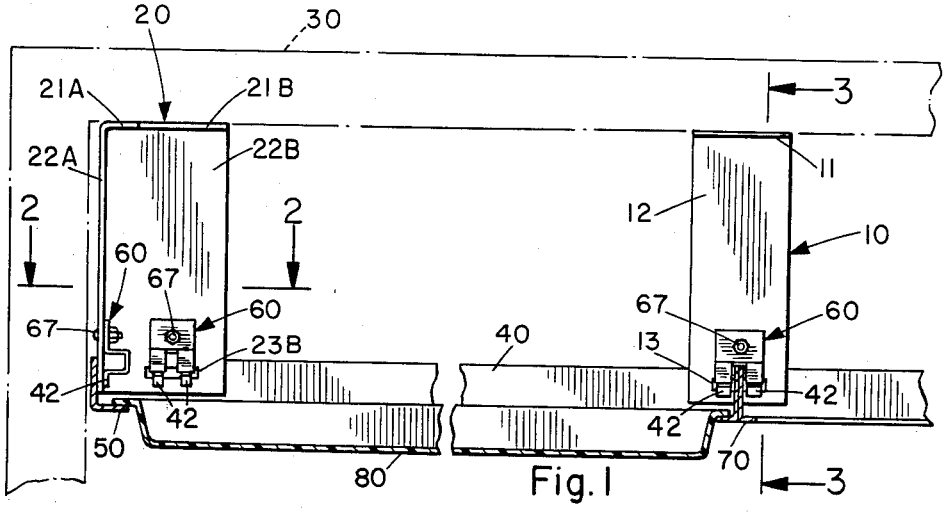
FIG. 1 of the drawings is a side elevation view, partially in section, of a portion of a suspended-ceiling framework assembly constructed in accordance with the invention.

An exemplary embodiment of a framework assembly constructed in accordance with the invention is illustrated in FIGS. 1–4 attached to a support structure such as an elevator cab where it is used to support a typical ceiling panel.

The illustrated assembly includes a two-inch wide steel bracket, side bracket 10, with which to hang a section of framing rail from a suitable support structure. Bracket 10 has a flange portion 11 for use in attaching the bracket to a support structure and a downwardly-extending portion 12 that extends about five inches from the support structure. The downwardly-extending portion has opposed flat faces and a one inch by one-quarter inch rectangularly-shaped slot, slot 13, into which a section of framing rail is hooked.

The illustrated assembly also includes corner bracket 20 with which to hang two sections of rail placed at right angles to form a corner. Corner bracket 20 is somewhat like two of the side brackets joined together at right angles. It includes flange portions 21A and 21B, and downwardly-extending portions 22A and 22B that each define a rectangularly-shaped slot. Slot 23B is visible in FIG. 1.

These two brackets are representative of others that may be used in a framework assembly. They are attached in FIG. 1 to elevator cab 30 by suitable means such as screws.

A section of framing rail, side rail 40 is shown in FIG. 1 mounted on side bracket 10 and corner bracket 20. Each side rail comprises an elongate web which has a transverse ceiling panel support flange and transversely projecting hooks or lugs that extend through the rectangularly-shaped slots, downwardly-extending portion 42 of each of the lugs being visible. FIG. 1.

Another framing rail, side rail 50, is illustrated in FIG. 1 mounted on corner bracket 20 generally perpendicular to side rail 40. In addition, a cross rail, cross rail 70, is illustrated extending to side bracket 10 generally perpendicular to side rail 40. These rails support ceiling panels such as the illustrated panel 80 and they are retained in place by retaining clips 60 that are mounted on the brackets by suitable means such as screw-washer-nut combination 67.

Figure 2:
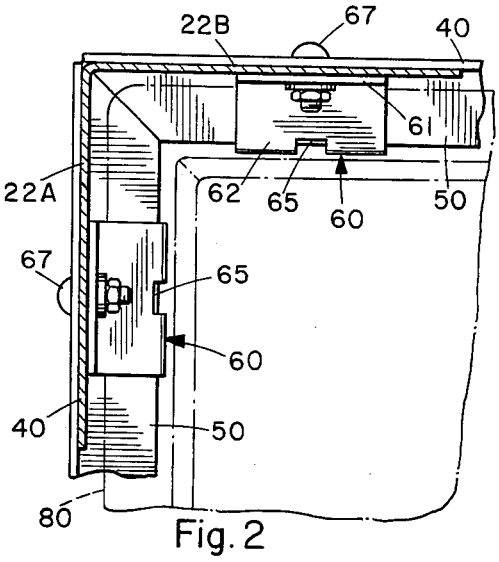
FIG. 2 is an enlarged sectional view taken on line 2—2 of FIG. 1.

The retainer clips extend into the rectangularly-shaped slots to hold the lugs and side rails in predetermined alignment with the brackets. They also prevent the lugs from being withdrawn from the slots. Two such clips are used on the corner bracket as shown in FIG. 2 with the side rails abutting at the corner in a tight miter joint.

Figure 3:
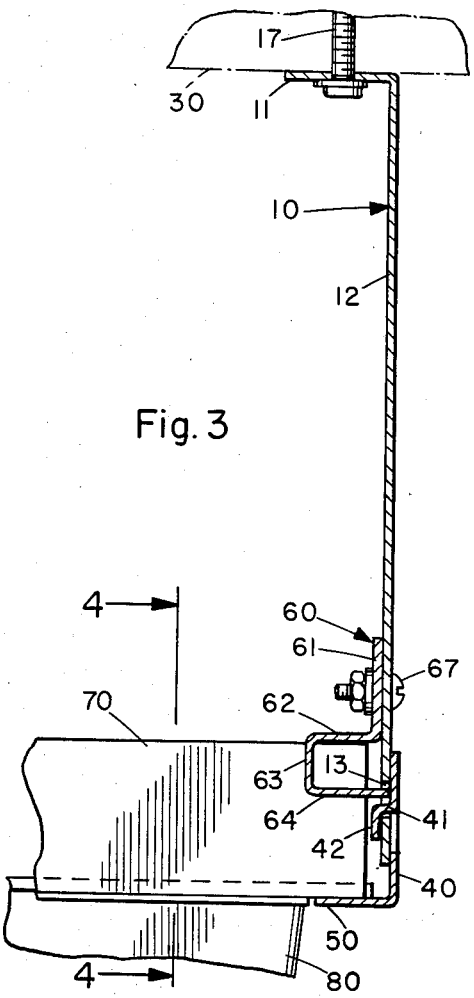
FIG. 3 is an enlarged sectional view taken on line 3—3 of FIG. 1.

Further details of the assembly are shown in FIG. 3 where side rail 10 is shown to have a flange portion attached to the elevator cab 30 by bolt 17. A lug comprising outwardly-extending portion 41 and downwardly-extending portion 42 is formed on rail 40 so that it fits through rectangularly-shaped slot 13.

As illustrated in FIG. 3, retaining clip 60 comprises upper portion 61 which is bolted by screw-washer-nut combination 67 to bracket 10. The retaining clip also includes outwardly-extending portion 62, downwardly-extending portion 63, and inwardly-extending portion 64 in a U-shaped configuration that extends into rectangularly shaped slot 13. The retaining clip holds the outwardly-extending portion 41 of the lugs downwardly in the slot to maintain correct alignment of the side rail with the side brackets. This also serves to prevent the lugs from being removed from the slot since downwardly-extending portion 63 is maintained in a position where it is hooked onto the bracket. The illustrated embodiment includes two lugs extending through each rectangularly-shaped slot for added ridigity and ease of alignment, although one lug per slot is within the inventive concepts herein disclosed.

The side rail can be hooked onto the bracket and the retainer clip bolted in place with a minimum of skill and manual dexterity (one screw) while still maintaining predetermined alignment of the two components.

Figure 4:
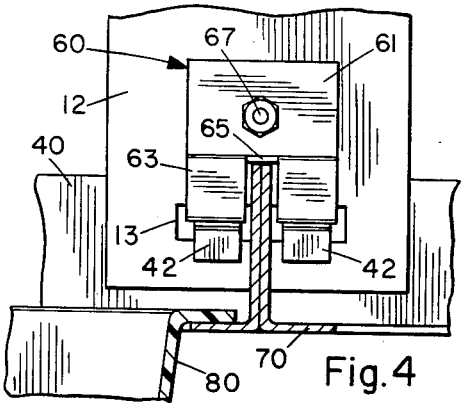
FIG. 4 is a sectional view taken on line 4—4 of FIG. 3.

The illustrated retainer clip includes opening 65 for receiving a T-shaped cross rail, such as cross rail 70 in FIG. 4. When used with a cross rail, outwardly-extending portion 62 of the retainer clip bears downwardly against the cross rail, which in turn bears downwardly against the side rail to retain the lugs downward in the slot so that correct alignment is maintained.

Figure 5:
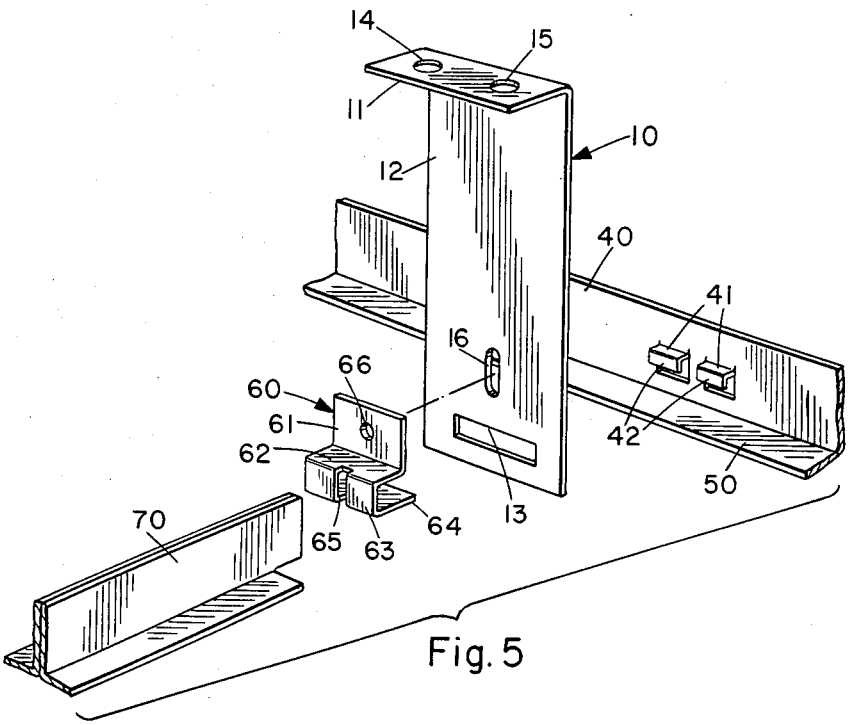
FIG. 5 is an exploded perspective view of the assembly of FIGS. 3 and 4.

The exploded perspective view of FIG. 5 illustrates further attributes of the illustrated embodiment. Rail 40 has two lugs, each of which comprises an outwardly-extending portion 41 and a downwardly-extending portion 42. These lugs fit into the rectangular-shaped slot 13 in side rail 10. The flange portion of side rail 10 includes holes 14 and 15 with which to attach the bracket to a suitable support structure. The side bracket includes hole 16 which is elongated in the manner illustrated to allow adjustment of the position of retainer clip 60 so that inwardly-extending portion 64 can be adjusted to bear downwardly on outwardly-extending portion 41 of each of the lugs. Although not shown in FIG. 5, screw-washer-nut combination 67 is inserted through hole 66 and hole 16 to mount the retainer clip.

Finally, cross rail 70 is slid into opening 65 in the retainer clip so that it is maintained in proper alignment with the other components.

So, the assembly can be quickly and easily assembled with minimum skill and manual dexterity while still preserving correct alignment. In addition, retainer clip 60 serves to inhibit upward movement of a ceiling panel so that they are less easily shoved upward out of place by an elevator occupant.

Figure 6:
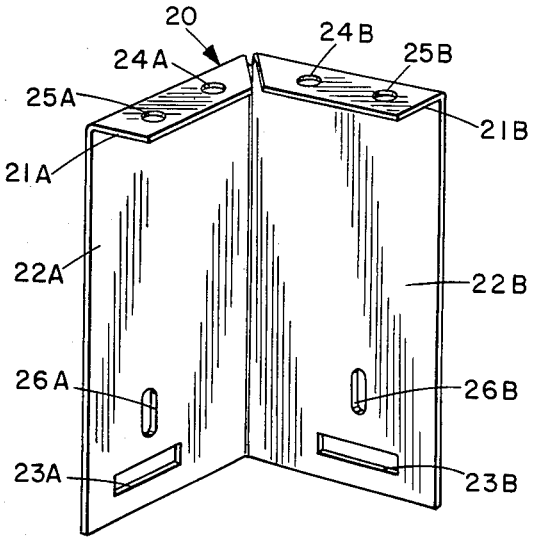
FIG. 6 is a perspective view of the corner bracket of FIG. 2.

FIG. 6 focuses on corner bracket 20. It is much like two side brackets connected together to form a right angle. It includes holes 24A and 25A in upper flange 21A and holes 24B and 25B in upper flange 21B for use in attaching the corner flange to a support structure. Holes 26A and 26B are provided for mounting retainer clips. They correspond to hole 16 in side bracket 10. Although two side brackets can be used in a corner, corner bracket 20 serves to maintain correct perpendicular alignment with minimum effort in the field.

Thus, this invention provides a new and improved suspended ceiling framework assembly that facilitates easy field assembly. It is particularly well suited for elevator cabs and appropriate for use wherever a suspended-ceiling framework is needed.

As various changes may be made in the form, construction, and arrangement of the procedures and parts described herein, without departing from the spirit and scope of the invention and without sacrificing any of its advantages, it is to be understood that all matter herein is to be interpreted as illustrative an not in any limiting sense.

What is claimed is:

1. A framework assembly for supporting ceiling panels from an overhead support structure, comprising:

a bracket having first and second opposite flat faces and a support slot extending through said bracket;

means for suspending the bracket vertically from an overhead support structure;

a first framing rail comprising an elongate web having at least one transverse flange for supporting an edge of a ceiling panel, the web having hook means projecting transversely from the web for hook-like engagement through said support slot for supporting said web in a first horizontal direction flat against one of said flat faces of said bracket; and a retainer clip releasably secured to the opposite face of said bracket to said first framing rail, the retainer clip having a retaining portion projecting through said support slot above and in the opposite direction to said hook means to retain said hook means in said slot.

2. The assembly as claimed in claim 1, wherein said retainer clip has a cross rail retaining slot facing in a direction transverse to said first horizontal direction, the assembly further including at least one cross rail having projecting means at one end for projecting into said cross rail retaining slot to retain said cross rail in a second horizontal direction transverse to said first direction.

3. The assembly as claimed in claim 1, wherein said retainer clip is releasably secured to said bracket on the opposite side of said bracket to said framing rail, and said clip is of generally U-shaped configuration, comprising an outwardly projecting portion extending away from said bracket and spaced above said flange, a downwardly projecting portion, and an inwardly projecting portion comprising said retaining portion projecting inwardly through said slot, said clip having a vertical cross rail retaining slot in its downwardly projecting portion, and the assembly further comprising a cross rail having means at one end for projecting into said cross rail retaining slot for retaining said cross rail between said outwardly projecting portion of said clip and said flange of said framing rail, said cross rail retaining slot and framing rail flange comprising means for supporting said cross rail in a second horizontal direction transverse to said first horizontal direction.

4. The assembly as claimed in claim 1, wherein the framing rail hook means comprises a pair of spaced apart hooks for fitting through said slot, each hook having a downwardly extending portion for projecting downwardly from said slot on the opposite side of said bracket to said framing rail.

5. The assembly as claimed in claim 1, wherein the retainer clip includes means for preventing a ceiling panel supported by the framing rail from being pushed upward.

6. The assembly as claimed in claim 5, wherein said means for preventing a ceiling panel from being pushed upward comprises an outwardly projecting portion of said retainer clip for projecting over the edge of a ceiling panel supported on said flange.

7. The assembly as claimed in claim 1, further including a corner bracket for supporting two framing rails at right angles to one another at a ceiling panel corner, means for supporting the corner bracket from an overhead support structure, the corner bracket comprising first and second vertical sections at right angles to one another, each section having a support slot for receiving the hook means of a respective framing rail.

8. A framework assembly for supporting ceiling panels, comprising:

a bracket comprising a flat, plate-like member having opposite flat faces and a support slot;

means for suspending the bracket vertically from an overhead support structure;

a first framing rail comprising an elongate flat web having at least one transverse flange for supporting the edge of a ceiling panel and hook means projecting transversely from the web for engagement through said support slot to support said rail to extend in a first horizontal direction with said web first against one of said flat faces of said bracket and said flange projecting beneath and across the lower edge of said bracket;

a retainer clip having an upper portion releasably secured to said bracket above said support slot on the opposite face of said bracket to said framing rail, the retainer clip having a first, outwardly projecting portion projecting away from said upper portion and a second, inwardly projecting portion projecting through said slot above said hook means to retain said hook means in said slot, the outwardly projecting portion having a cross rail retaining slot for locating a cross rail in a horizontal direction transverse to said first direction;

a cross rail having projecting means at one end for projecting into said cross rail retaining slot and acting between said retainer clip and framing rail flange to support said cross rail to extend in said transverse horizontal direction.

9. The assembly according to claim 8, in which said cross rail is a T-section rail.

* * * * *

UNITED STATES PATENT AND TRADEMARK OFFICE

CERTIFICATE OF CORRECTION

PATENT NO. : 4,630,423

DATED : December 23, 1986

INVENTOR(S) : LARRY W. LIND

It is certified that error appears in the above-identified patent and that said Letters Patent is hereby corrected as shown below:

Column 5, line 21, Claim 8, change the word "first" to --flat--.

Signed and Sealed this

Twenty-first Day of April, 1987

*Attest:*

DONALD J. QUIGG

*Attesting Officer*

*Commissioner of Patents and Trademarks*